US006864487B1

(12) United States Patent
McMurtry et al.

(10) Patent No.: US 6,864,487 B1
(45) Date of Patent: Mar. 8, 2005

(54) ENVIRONMENTAL SAMPLER FOR MASS SPECTROMETER

(76) Inventors: Gary M McMurtry, 963 Kaahue St., Honolulu, HI (US) 96825; Daniel N Kokubun, 94-207A Kikepa Pl., Waipahu, HI (US) 96797

( * ) Notice: Subject to any disclaimer, the term of this patent is extended or adjusted under 35 U.S.C. 154(b) by 15 days.

(21) Appl. No.: 10/053,687

(22) Filed: Jan. 21, 2002

(51) Int. Cl.[7] ..... G21K 5/10

(52) U.S. Cl. ..... 250/442.11; 250/306; 250/311; 250/310

(58) Field of Search ..... 250/310, 306, 250/442.11, 288, 281, 289; 356/326

(56) References Cited

U.S. PATENT DOCUMENTS

| | | | | | |
|---|---|---|---|---|---|
| 3,946,759 | A | * | 3/1976 | Mercier | 138/30 |
| 4,201,913 | A | | 5/1980 | Bursack et al. | |
| 4,386,852 | A | | 6/1983 | Cassidy et al. | |
| 4,562,351 | A | | 12/1985 | Atherton et al. | |
| 4,590,165 | A | | 5/1986 | Gilles et al. | |
| 4,601,211 | A | * | 7/1986 | Whisler | 73/863.33 |
| 4,723,577 | A | * | 2/1988 | Wusterbarth | 138/30 |
| 4,879,458 | A | * | 11/1989 | Brunfeldt et al. | 250/288 |
| 5,397,989 | A | * | 3/1995 | Spraul et al. | 324/321 |
| 5,705,928 | A | | 1/1998 | Haner et al. | |
| 5,841,136 | A | | 11/1998 | Holle et al. | |
| 6,177,991 | B1 | * | 1/2001 | Okuda | 356/326 |
| 6,186,012 | B1 | * | 2/2001 | Kenny et al. | 73/863.12 |
| 6,190,316 | B1 | | 2/2001 | Hirabayashi et al. | |
| 6,288,783 | B1 | * | 9/2001 | Auad | 356/410 |
| 6,483,778 | B1 | * | 11/2002 | Pozzo et al. | 367/172 |
| 2002/0079442 | A1 | * | 6/2002 | Fries et al. | 250/281 |

FOREIGN PATENT DOCUMENTS

| | | | | |
|---|---|---|---|---|
| GB | 2178534 | A | * 2/1987 | G01N/35/04 |

* cited by examiner

*Primary Examiner*—John R. Lee
*Assistant Examiner*—Kalimah Fernandez
(74) *Attorney, Agent, or Firm*—Michael I. Kroll

(57) ABSTRACT

An environmental sampler for a mass spectrometer is disclosed that provides for controlled introduction of small amounts of fluids or gases into the vacuum system of the mass spectrometer under severe environmental conditions. Accurate calibration checks of the environmental sampler and mass spectrometer during remote autonomous operation is possible by means of an internal standard reservoir integral with the environmental sampler.

16 Claims, 11 Drawing Sheets

ENVIRONMENTAL SAMPLER FOR MASS SPECTROMETER

BACKGROUND OF THE INVENTION

1. Field of the Invention

The present invention relates generally to sampling systems for mass spectrometers and, more specifically, to an environmental sampler for a mass spectrometer that allows for controlled introduction of small amounts of fluids or gases into the vacuum system of the mass spectrometer under severe environmental conditions. Accurate calibration checks of the sampler and mass spectrometer during remote autonomous operation is possible by means of an internal standard reservoir integral with the sampler of the present invention. A computer-controlled stepper motor moves a rod set which samples the external sample and the internal standard alternatively.

The forward motion of the rods (toward the outside of the pressure/vacuum housing) in predetermined numbers of steps samples the internal standard reservoir while the reverse motion of the rods (toward the inside of the pressure housing) samples the external environment. The standard reservoir is designed to be at the same pressure as the external sample. This configuration provides a pressure-compensated rod set, reducing the mechanical forces on the stepper motor. This configuration also ensures a constant ratio of sample to standard volume and mass (approximately one to one). Hydraulic seals and O-rings keep external fluids and gases from entering the sampler, wherein surface-bound fluids and dissolved gases are evaporated from the sampler rod into the vacuum system. Dry gases (e.g. low moisture air) enter the sampler via small calibrated leaks in the rod during movement.

Initially, the sampler is mass spectrometer leak tight (no detectable flow). Flow into the sampler vacuum chamber is accomplished by engineering small calibrated leaks in the rod/seal system thereby permitting extremely small amounts of sample to be repeatedly and reliably introduced into the vacuum system of the mass spectrometer as the rods travel back and forth. This small sample capability reduces the pumping load on the vacuum system and permits extended in situ operation by virtue of its low power consumption. Its operational pressure range (less than one atmosphere to greater than 400 atmospheres) allows autonomous operation in a variety of earth and planetary environments (outer space to full-ocean water depths).

A unique feature of the invention is the very small amount of sample acquired, which is rapidly expanded into a vapor prior to introduction to the mass spectrometer interface. Therefore, initial sample temperatures can be quite high without serious effect on the mass spectrometer. Temperature maximums are only dictated by the choice of polymers for the sampler seal and the plenum inlet hoses. Management of sample temperatures in excess of 200□C is possible if high temperature polymers such as silicon or teflon™ are used.

The present invention further includes a removeable external vacuum port to ambient that allows pumping and monitoring of a sample/standard waste vacuum within the mass spectrometer pressure housing. A removable external plenum allows directional flow of gas or fluid over the sampler rod pumped from a remote region of interest.

The present invention is primarily designed for a mass spectrometer, but it can be used in any application where small quantities of sample are needed from the environment, such as in gas or liquid chromatography, capillary electrophoresis, or any combination of these and other analytical techniques with mass spectroscopy.

2. Description of the Prior Art

There are other samplers for mass spectrometers. Typical of these is U.S. Pat. No. 4,201,913 issued to Bursack et al. on May 6, 1980.

Another patent was issued to Cassidy et al. on Jun. 7 1983 as U.S. Pat. No. 4,386,852. Yet another U.S. Pat. No. 4,562,351 was issued to Atherton et al. on Dec. 31, 1985 and still yet another was issued on May 20, 1986 to Gilles et al. as U.S. Pat. No. 4,590,165.

Another patent was issued to Whistler on Jul. 22, 1986 as U.S. Pat. No. 4,601,211. Yet another U.S. Pat. No. 4,879,458 was issued to Brunfeldt et al. on Nov. 7, 1989. Another was issued to Spraul et al. on Mar. 14, 1995 as U.S. Pat. No. 5,397,989 and still yet another was issued on Jan. 6, 1998 to Haner et al. as U.S. Pat. No. 5,705,928.

Another patent was issued to Holle et al. on Nov. 24, 1998 as U.S. Pat. No. 5,841,136. Yet another U.S. Pat. No. 6,177,991 was issued to Okuda on Jan. 23, 2001. Another was issued to Kenny et al. on Feb. 13, 2001 as U.S. Pat. No. 6,186,012 and still yet another was issued on Feb. 20, 2001 to Hirabayashi et al. U.S. Pat. No. 6,190,316.

An apparatus for introducing a gaseous sample into a mass spectrometer is disclosed which includes a hollow antechamber or cavity disposed between the sample stream and the high vacuum enclosure. Orifice openings are provided in the antechamber which allow the antechamber to communicate both with the high vacuum enclosure and the sample stream. An electrically operated pulsed valve is used to admit a series of small volumes of sample by pulses of controlled duration and frequency such that the sample flow from the antechamber into the high vacuum enclosure can be made to resemble one of essentially constant flow.

A phase synchronization apparatus useful for synchronizing the sample signal and the demodulation signal at a spectrometer includes a stepper motor the position of which is controlled so that the desired phase synchronization is ensured.

The invention consists of a mass spectrometer having a sample insertion probe on which a reference compound and an unknown sample can be simultaneously introduced without mixing into a field ionization or ion or neutral particle bombardment ion source. An insulated support is mounted by a parallel hinge on the end of the probe shaft. Two or more separated segments or emitter wires, one carrying the unknown sample, another carrying an appropriate reference compound, are mounted on a base member which is fitted to the support. A drive shaft, concentric with the outer probe shaft, has an eccentric peg on the end, which engages with a cam on the support, so that rotation of the drive shaft results in an oscillating motion of the segments or emitters, alternately positioning them in the optimum position for ionization. A spectrum of the sample or the reference compound can be obtained when required by selecting the appropriate position of the drive shaft. Rotation of the drive shaft may be controlled by a servo-mechanism and a computer. As a result, improved accuracy of mass measurement of peaks in the mass spectrum of the sample is achieved.

An automatic sampling method for introducing a diluted viscous sample into an instrument for analysis for trace elements. The automatic sampling system includes a tube assembly, a member for mounting the tube assembly in proper relation, means for maintaining, between sampling, the free end of the tube assembly in a cleaning solution, and means for inserting the free end of the tube assembly into a sample contained within a container. Preferably, the instrument is a spectrometer, the samples are organic and aqueous samples, such as oils, brines, sludges, plating solutions and the like, and the trace elements include wear metals and also other elements, such as calcium, barium, zinc, sodium, magnesium, boron, phosphor and the like.

A multi-port valve uses a flexible sample tube to selectively intercept gases flowing from inlet ports into a common manifold space. The manifold space is placed under sufficient vacuum to insure that gas samples will be selectively received by the sample tube when the sample tube is placed in close proximity to the selected inlet port to be sampled. The sample tube is arranged so that gases to be sampled from the selected port wash over the entrance end of the sample tube so that contaminated or mixed gases from the manifold space are prevented from entering the sample tube. The sample tube is mounted to pivot inside a valve body and is moved by a sample tube guide which rotates inside the valve body to selectively align the sample tube with the inlet ports. The valve body may be sealed by a cover through which the valve guide is driven to rotate by a magnetic coupling, or by a bearing seal through which the sample tube guide projects. The sample guide may be rotated in a stepwise fashion by a stepper motor for slow collection rates, or may be rotated quickly by a motor for rapid sampling. Magnetic detectors or a shaft decoder may be used to monitor the position of the sample tube guide. The multi-port valve may be used in a system in which a measuring device such as a mass spectrometer and a data system are used.

An automated sample inlet system for sequentially introducing a plurality of indium encapsulated samples into a mass spectrometer wherein the samples are placed in a micro tube and loaded into a circular carousel under a vacuum bell jar maintained at ambient temperature. The samples are systematically advanced by rotating the carousel resulting in each sample sequentially falling through a delivery tube containing an inverted ball valve into a sample vaporizing chamber within an oven. An additional pair of sapphire ball valves in communication with the glass vaporizing chamber are sequentially opened and closed in a preprogrammed manner along with the opening and closing of the thermal inverted ball valve and the indexing of the carousel such as to automatically evacuate the glass inlet system within the oven, introduce a new sample and vaporize it and then inject this vapor into a mass spectrometer. Such a system is useful in running large numbers of mass spectrometer analyses of hydrocarbon liquids and the like.

An NMR spectrometer (10) for the measurement of liquid samples having a probe head (20) exhibiting an upper and a lower support (21 or 22), a connector (5) for a feed conduit (15) for the introduction of a liquid sample (1) into the spectrometer (10) and a connector (6) for a drain conduit (16) for the drainage of the liquid sample (1) out of the spectrometer (10), a sample tube (3), arranged between the upper and the lower supports (21 or 22), for the acceptance of the fluid sample (1), whereby the one end of the sample tube (3) is connected to the connector (5) for the feed conduit (15) and the other end to the connector (6) for the drain conduit (16), exhibits, coaxially to the sample tube (3) a further tube (4) for the acceptance of a calibration fluid (2) which, on one end, is connected to an additional connector (7) for a feed conduit (17) to introduce the calibration fluid (2) into the spectrometer (10) and, on its other end, to an additional connector (8) for a drain conduit (18) to drain the calibration fluid (2) out of the spectrometer (10). In this manner, it is possible to measure the sample fluid (1) in a simple fashion, without the previous mixing of additives and, subsequent to the measurement, to regain the sample fluid in its original state, while allowing for the introduction of a calibration fluid (2) for field stabilization and for the quantitative comparison of line intensities.

A sample delivery system for a flow-through NMR analysis is provided, which utilizes pressurized gas as a means for conveying a sample into and out of an NMR spectrometer. Two sources of gas pressure, a forward pressure and back pressure, oppose the sample within the tubing of the sample delivery system and the tubing of the flow-through system which are operatively coupled together. Conveyance of the sample in any direction within the tubing is achieved by adjusting the pressure differential. Precise positioning of the sample in the magnetic field center and complete removal of the sample from the NMR spectrometer when analysis is complete are achieved by using a signal processor which receives signals from the NMR detector or other detectors positioned along the length of the tubing. These signals provide an indication of the position of the sample in the tubing. The signal processor uses this information to adjust the forward and the back pressure, thereby achieving the desired positioning of the sample.

A system and a method for the introduction of sample supports, which hold large numbers of analysis samples, into the ion source region of a mass spectrometer. The sample supports are especially intended for the ionization method using matrix-assisted desorption through laser bombardment (MALDI). The system consists of using an evacuable, sealable and removable cassette which, instead of using a through-passage lock chamber with two lock valves, can be attached in a simple manner to the entrance opening for the ion source of the mass spectrometer. Only the entrance opening has a lock valve, and the expensive second lock valve in the lock chamber is no longer needed. The cassette can also be used for protected transport and for storage of the sample supports, and in particular for storage of the samples under protective gas or vacuum.

A measuring device such as a spectrometer uses an automatic sample changer for carrying a plurality of samples. The automatic sample changer may include a rotary circular disk rotatable around its central shaft by a stepping motor for changing positions of the samples which are positioned in a circle around the central shaft of the disk. A memory device preliminarily storing control data for each of different kinds of automatic sample changers is provided. The automatic sample changer, when connected to a control unit in the main body, serves to receive control signals for controlling motions of the motor and to transmit data stored in the memory device through a connector. The main body of the measuring device contains a control unit which serves to read out the control data from the memory device, to use the received control data to generate the control signal and to transmit the generated control signal to the automatic sample changer.

A manipulator apparatus, system and method for measuring analyses present in sample tubes. The manipulator apparatus includes a housing having a central bore with an inlet end and outlet end; a plunger mechanism with at least a portion thereof slideably disposed for reciprocal movement within the central bore, the plunger mechanism having a tubular gas channel with an inlet end and an outlet end, the gas channel inlet end disposed in the same direction as said inlet end of the central bore, wherein the inlet end of said plunger mechanism is adapted for movement so as to expel a sample tube inserted in the bore at the outlet end of the housing, the inlet end of the plunger mechanism is adapted for connection to gas supply; a first seal is disposed in the housing for sealing between the central bore and the plunger mechanism; a second seal is disposed at the outlet end of the housing for sealing between the central bore and a sample tube; a holder mounted on the housing for holding the sample tube; and a biasing mechanism for returning the plunger mechanism to a starting position.

A living body fluid analyzing system includes a microdialysis for sending a first solution having an osmotic pressure which is substantially similar to a osmotic pressure of a body fluid into a living body and extracting a second solution from the living body. A first flow passage is provided in which the second solution from the microdialysis flows and a second flow passage is provided which mixes the second solution with an organic solution. Furthermore, there is provided a gas source and a gas flow controller which controls a flow quantity of the gas from the gas source and a third flow passage in which a gas introduced from the gas source flows. An ion source is provided having an orifice for spraying and ionizing the second solution from the second flow passage at an end of the third flow passage, and a mass spectrometer is provided for mass-analyzing the ions sprayed from the orifice.

While these mass spectrometer sampling devices may be suitable for the purposes for which they were designed, they would not be as suitable for the purposes of the present invention, as hereinafter described.

SUMMARY OF THE PRESENT INVENTION

A primary object of the present invention is to provide an environmental sampler for mass spectrometers that enables small amounts of gases or fluids to enter the vacuum system of a mass spectrometer under various environmental conditions.

Another object of the present invention is to provide an environmental sampler for mass spectrometers wherein the flow of said gases or fluids is regulated by the reciprocating movement of two parallel rods traveling therethrough and driven by a stepper motor.

Yet another object of the present invention is to provide an environmental sampler for mass spectrometers in which the rods have hydraulic seals and O-rings to form a seal and rod assembly, said seal and rod system including small calibrated leaks to provide flow therethrough into the sampler vacuum chamber during rod travel.

Still yet another object of the present invention is to provide an environmental sampler for mass spectrometers having a removable external plenum, which, in tandem with an external pump allows for directional flow of gases or fluids over the sampler rod from a selected region of interest.

Still another object of the present invention is to provide an environmental sampler for mass spectrometers wherein the sampler plenum permits relatively small amounts of sample or standard to be analyzed when statically confined therein.

Still yet another object of the present invention is to provide an environmental sampler for mass spectrometers having an internal standard reservoir that is pressure-compensated by a resilient bladder member.

Another object of the present invention is to provide an environmental sampler for mass spectrometers which provides sample volumes in consistent ratios from the external and internal sources, via the pressure compensated sample reservoir.

Yet another object of the present invention is to provide very small amounts of sample that are rapidly expanded so that initial sample temperatures can be quite high without serious effect on the mass spectrometer.

Yet another object of the present invention is to provide an environmental sampler for mass spectrometers having a removable external vacuum port to ambient that allows pumping and monitoring of a sample/standard waste vacuum within the mass spectrometer pressure housing.

Another object of the present invention is to provide an environmental sampler for mass spectrometers that is economical in cost to manufacture and operate.

Yet another object of the present invention is to provide an environmental sampler for mass spectrometers that is simple and easy to use.

Additional objects of the present invention will appear as the description proceeds.

The present invention overcomes the shortcomings of the prior art by providing an environmental sampler for mass spectrometers.

To the accomplishment of the above and related objects, this invention may be embodied in the form illustrated in the accompanying drawings, attention being called to the fact, however, that the drawings are illustrative only, and that changes may be made in the specific construction illustrated and described within the appended claims.

BRIEF DESCRIPTION OF THE DRAWING FIGURES

In order that the invention may be more fully understood, it will now be described, by way of example, with reference to the accompanying drawing in which.

Figure 1:
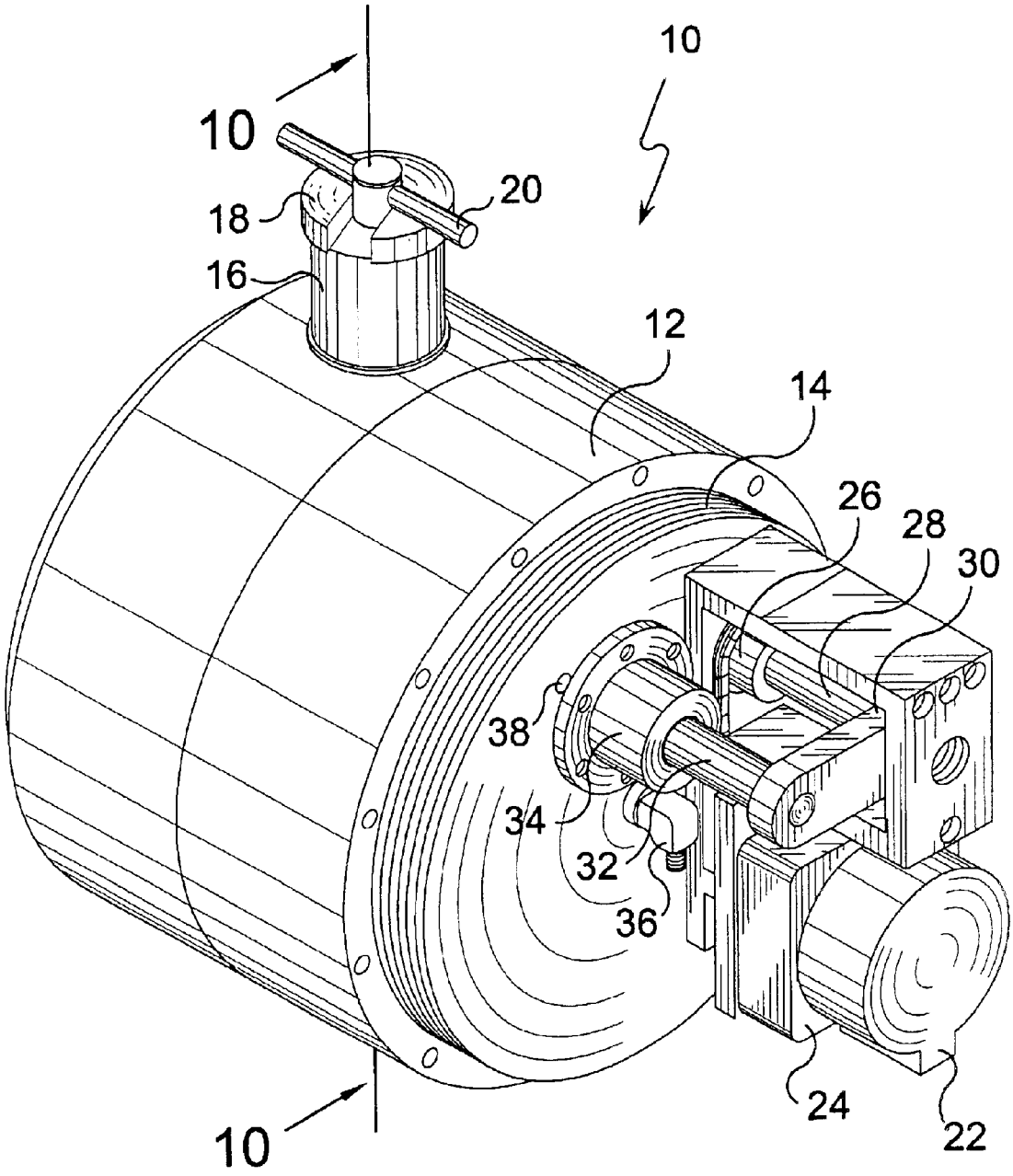
FIG. 1 is a rear perspective view of the present invention.

The foregoing and other objects and advantages will appear from the description to follow. In the description reference is made to the accompanying drawing, which forms a part hereof, and in which is shown by way of illustration of specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

DESCRIPTION OF THE REFERENCED NUMERALS

Turning now descriptively to the drawings, in which similar reference characters denote similar elements throughout the several views, the figures illustrate the Environmental Sampler for Mass Spectrometer of the present invention. With regard to the reference numerals used, the following numbering is used throughout the various drawing figures.

10 environmental sampler for mass spectrometer
12 environmental sampler housing
14 environmental sampler housing attachment o-ring grooves
16 vacuum port assembly
18 spacer
20 rotating cap assembly
22 stepper motor
24 stepper motor gear box
26 sprocket gear
28 lead screw
30 lead nut
32 driving rod
34 bearing
36 sample port
38 vacuum port
40 retaining ring
42 sampler rod
46 retaining ring
48 pressure-compensating bladder
50 plenum
52 inlet/outlet port
54 attachment ring
56 plenum chamber
58 sampler rod seal
60 vacuum chamber (sample/standard)
62 internal standard reservoir
64 threaded stud
66 o-ring seal
68 operational flowchart
70 vacuum chamber (waste)

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

FIG. 1 is a perspective rear view of the present invention showing the environmental sampler of the present invention. The device has a housing 12 with fastening means 14 for attaching to a mass spectrometer. The environmental sampler 12 has a stepper motor 22 and a stepper motor gear box 24 engaging a sprocket gear 26 driving a lead screw 28 having connection with a lead nut 30 connecting said lead screw 28 with a guide rod 32. The guide rod 32 advances and retracts according to the stepper motor 22 driven by control signals. The guide rod 32 has a guide rod bearing 34 to aid in smooth longitudinal displacement. The housing also has a sampler port 36 wherein environmental matter is introduced to the mass spectrometer for analysis. To evacuate the environmental sampler a vacuum waste port 38 is provided.

Also shown is vacuum port assembly 16 having spacer 18 and rotating cap assembly 20.

Figure 2:
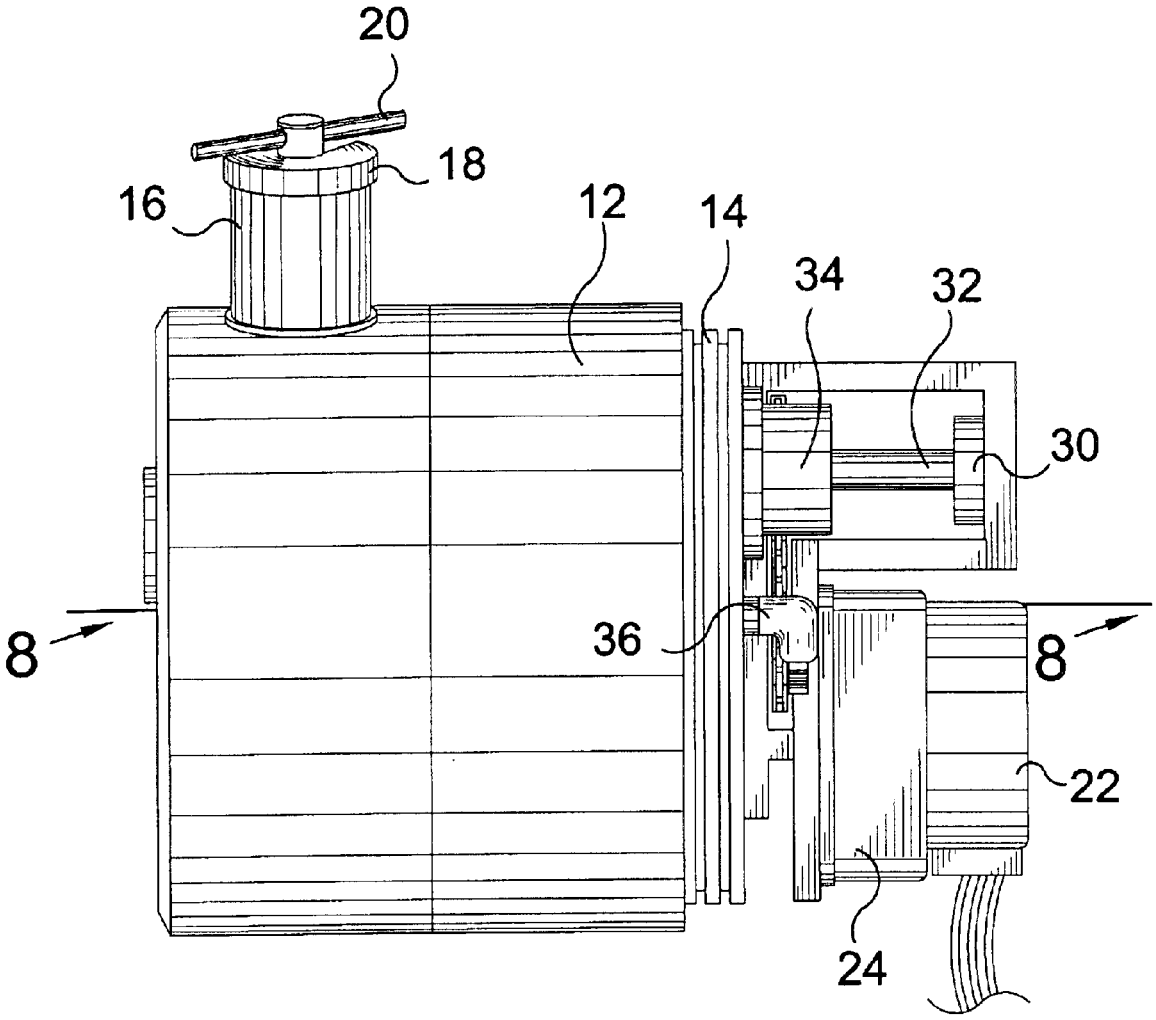
FIG. 2 is a side view of the present invention.

FIG. 2 is a side view of the present invention. Shown is the environmental sampler having a vacuum port assembly 16 spacer 18 and rotating cap assembly 20 for a mass spectrometer waste vacuum. The spacer element 18 provides for gas flow by holding back the spring of the internal o-ring seal. The rotating cap assembly 20 provides for the engagement/disengagement of the internal oaring seal. A vacuum may be drawn in the disengaged position. The vacuum may then be sealed in the engaged position. Also shown is the stepper motor 22 and stepper motor gear box 24 that drives the driving rod 32 by means of lead nut 30 through bearing 34.

Figure 3:
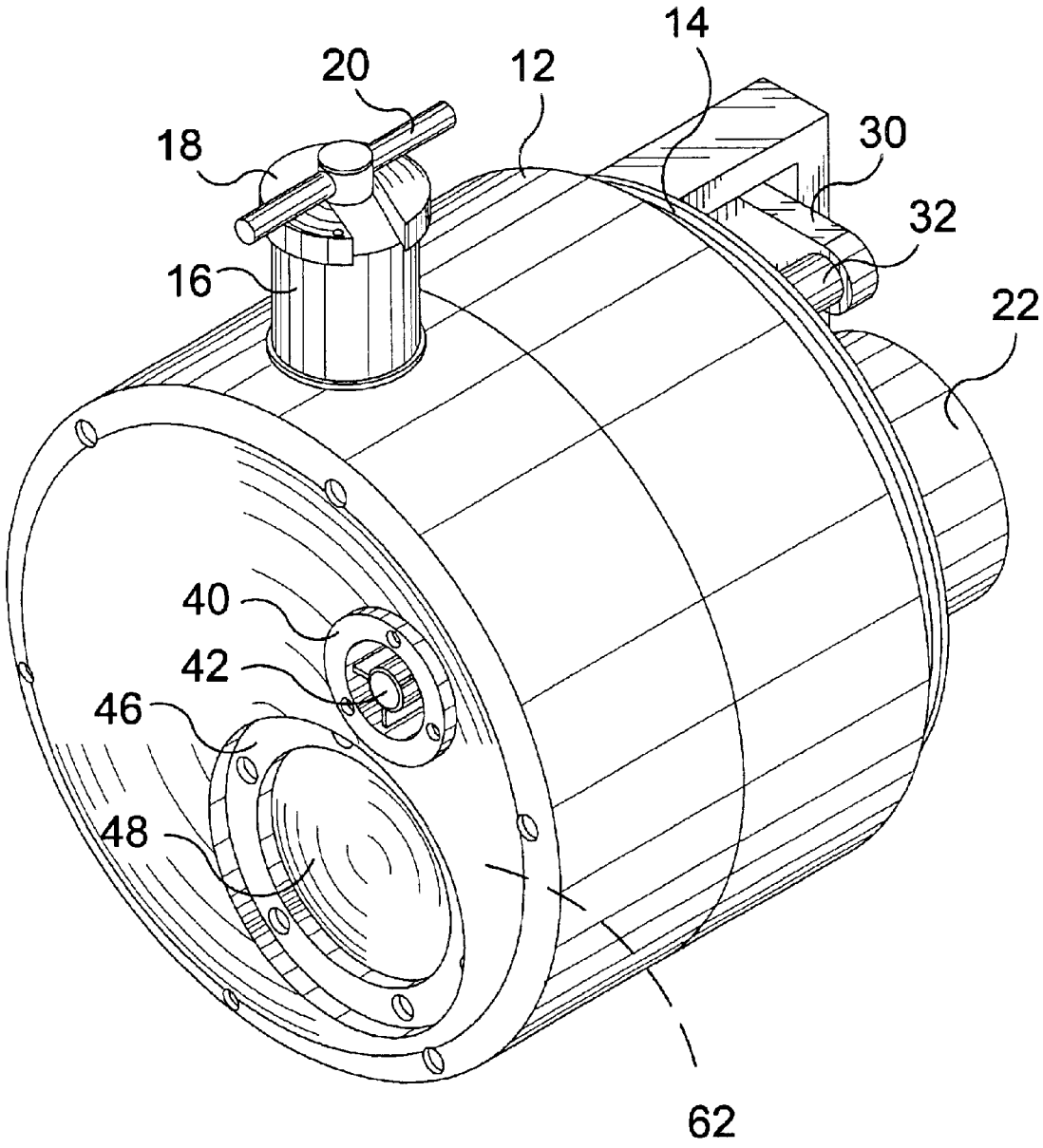
FIG. 3 is a front perspective view of the present invention.

FIG. 3 is a perspective view of the present invention. The pressure compensating bladder 48 is adjacent the internal standard reservoir 62 and assumes a concave or convex profile as dictated by the external pressure. The standard can be of any aqueous or organic solvent of known composition. The internal standard is sampled alternately with the external environment to provide the user with a benchmark as to the accuracy of sampling by constantly sampling a known composition thus allowing the user and/or computer to calibrate accordingly.

Figure 4:
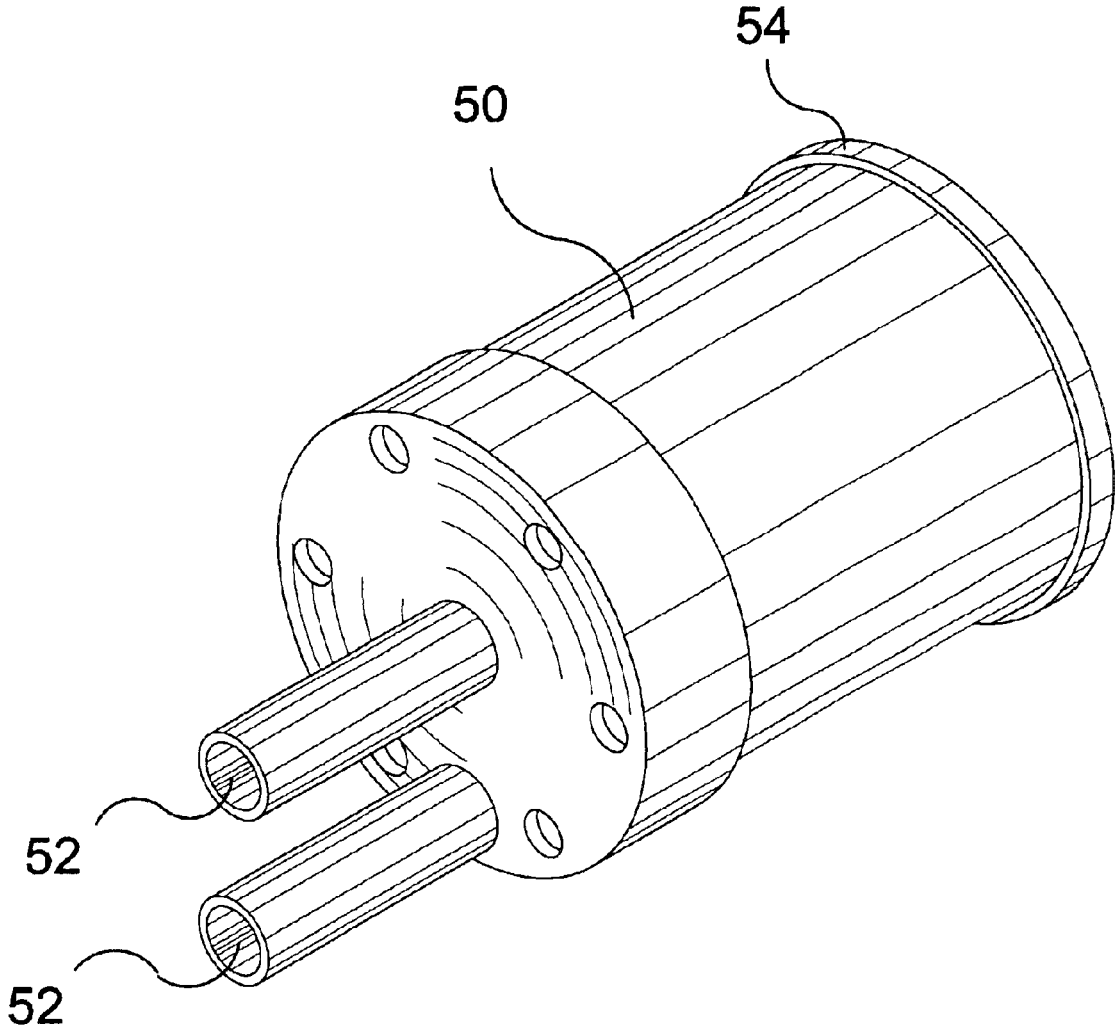
FIG. 4 is a perspective view of the plenum of the present invention.

FIG. 4 is a perspective view of the plenum assembly 50. The removable external plenum 50 allows for directional flow of gas or fluid from the external environment to pass over the sampler rod which is encased by the plenum assembly 50. The plenum assembly has an inlet and outlet port 52 providing access to an internal cavity wherein the sampler rod 42 moves into and out of under the control of the stepper motor 22. The plenum assembly is mounted to the environmental sampler housing 12 over the sampler rod 42 by using the attachment ring 54 in place of the retaining ring 40.

Figure 5:
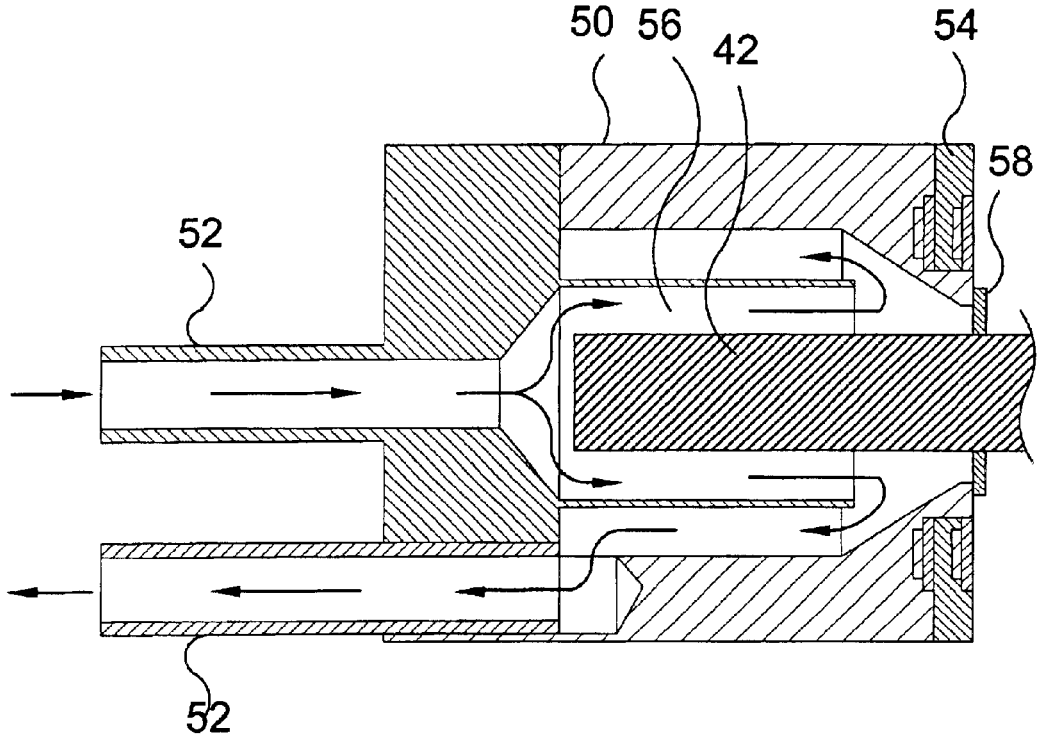
FIG. 5 is a cross sectional side view of the plenum assembly.

FIG. 5 is cross sectional side view of the plenum assembly 50. The plenum produces by means of the inlet and outlet port 52 an even flow of sample over all surfaces of the sampler rod 42. It also creates a directed flow impinging on the sampler rod seal 58. This minimizes the dead volume around the sampler rod 42 and delivers a constantly fresh supply of sample to the system. The small volume within the plenum chamber 56 allows for a rapid purge of the system when necessary. The plenum also provides for the sampling of a static volume contained therein.

Figure 6:
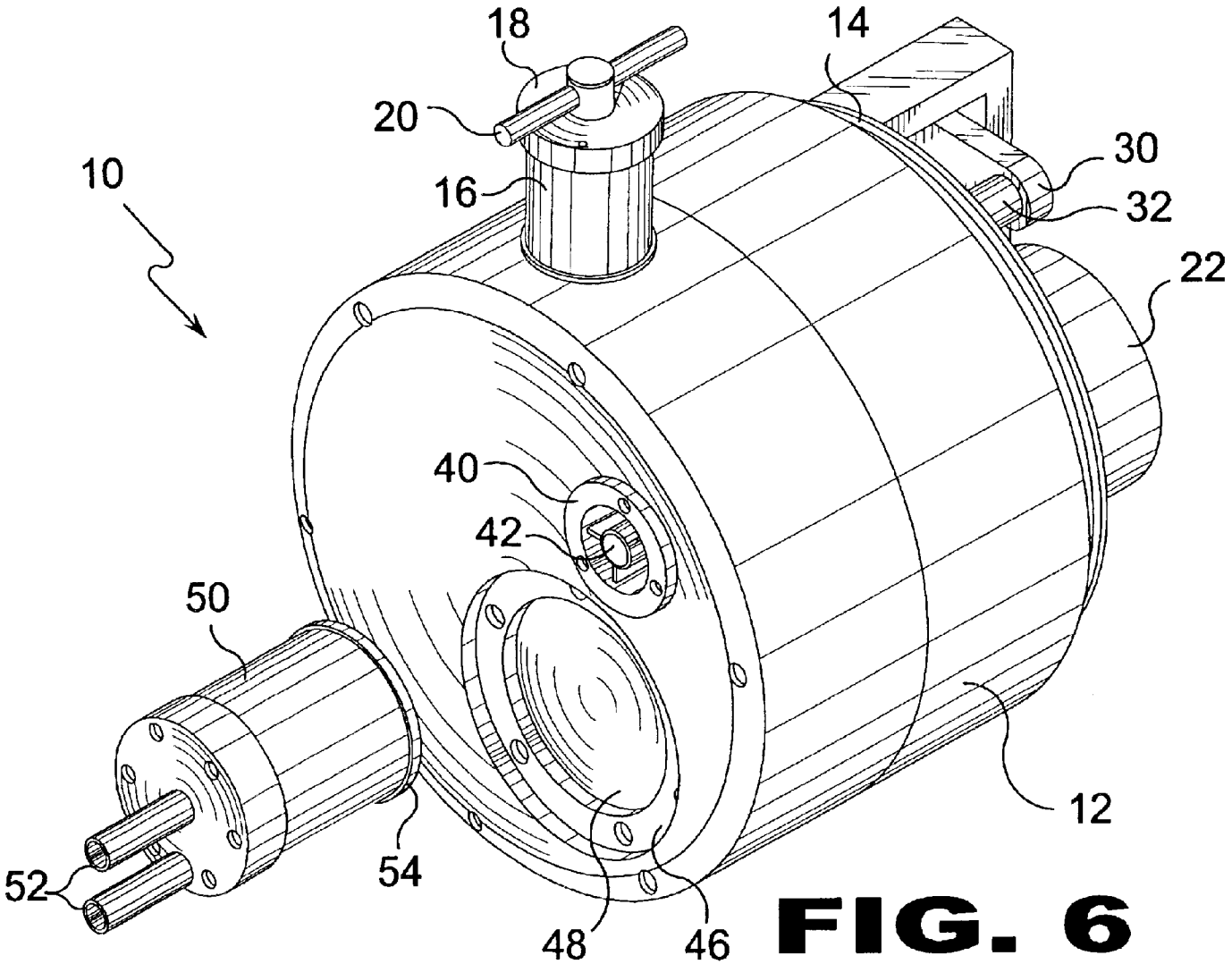
FIG. 6 is an exploded perspective view of the sampler and the plenum assembly.

FIG. 6 is an exploded view of the environmental sampler 10 and the plenum assembly 50. The plenum assembly 50 has inlet and outlet ports 52 providing access to the plenum chamber 56 and attaches to the environmental sampler housing 12 by means of the plenum attachment ring 54 which replaces the retainer ring 40 of the sampler and has a silicone gasket or other such sealing means located therebetween.

Figure 7:
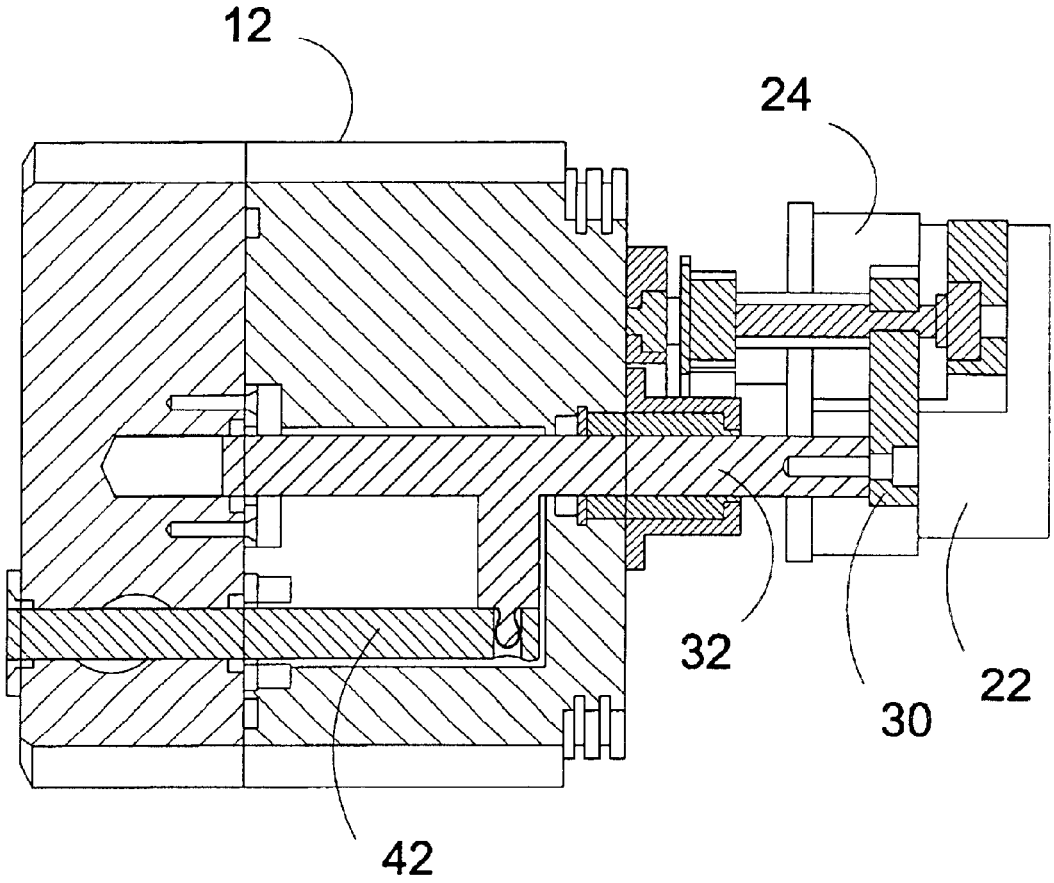
FIG. 7 is a cross sectional side view of the present invention.

FIG. 7 is a is a sectional view of the environmental sampler 10 of the present invention showing the front sampler rod 42 and the rear driving rod 32 with a ball joint connection therebetween encompassed by the housing 12. The stepper motor 22 by means of the stepper motor gear box 24 moves the driving rod 32 by means of lead nut 30 which in turn controls the movement of the sampler rod 42.

Figure 8:
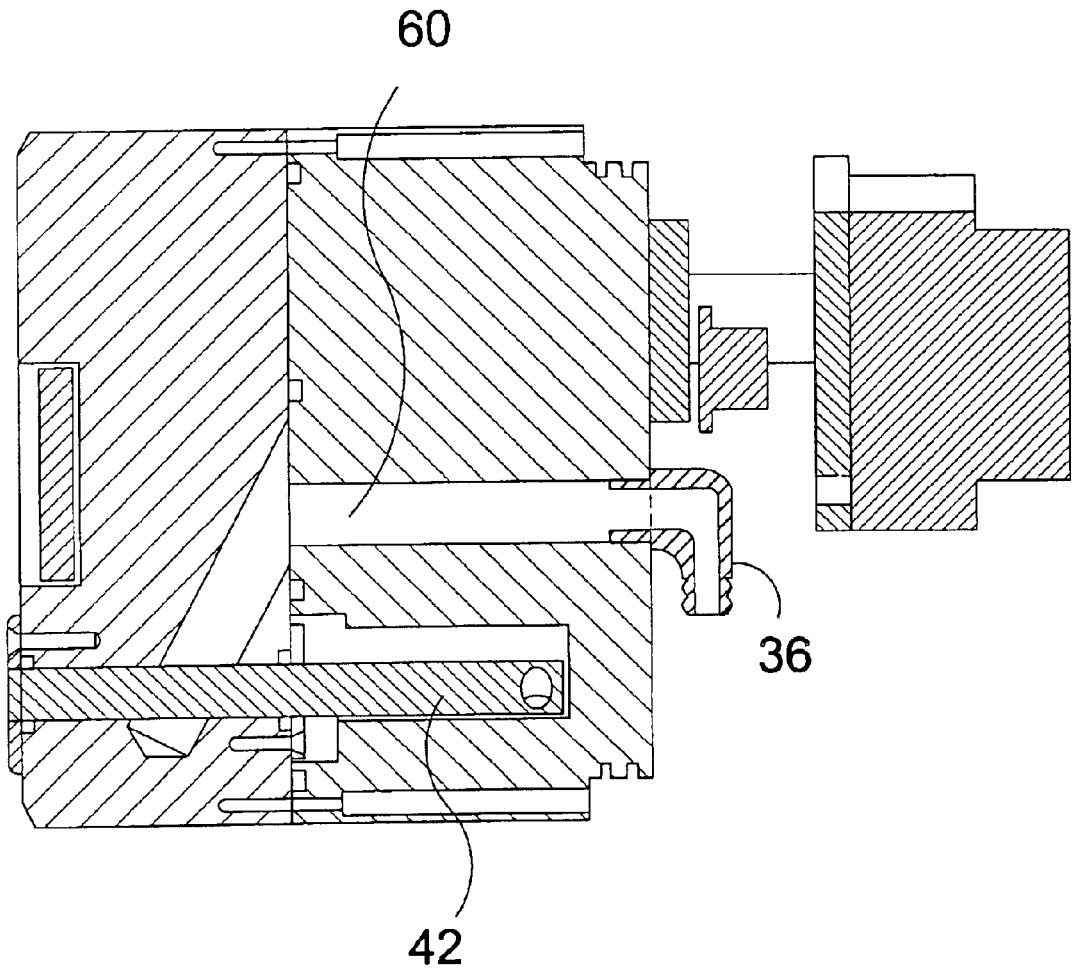
FIG. 8 is a cross sectional side view of the present invention.

FIG. 8 is a cross sectional side view of the present invention, taken from FIG. 2 as indicated showing the sample vacuum chamber 60 and sampler rod 42. The sample is directed by the mass spectrometer vacuum through the sample port 36.

Figure 9:
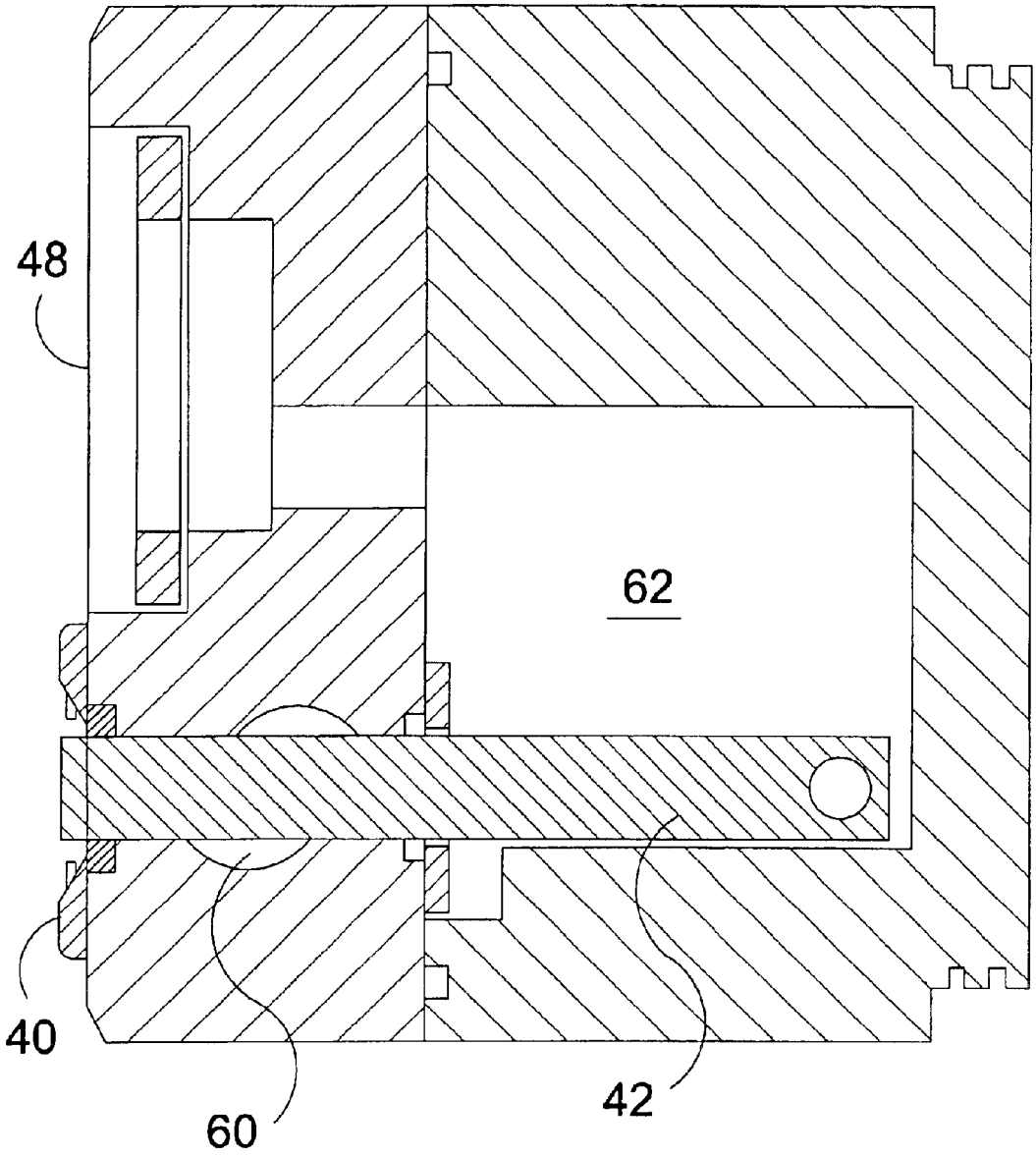
FIG. 9 is a cross sectional top view of the present invention.

FIG. 9 is a cross sectional side view of the present invention showing the internal standard reservoir 62 in relation to the pressure compensating bladder 48 and sampler rod 42. The sampler environmental material and standard reservoir material are drawn into the mass spectrometer through the vacuum chamber 60.

Figure 10:
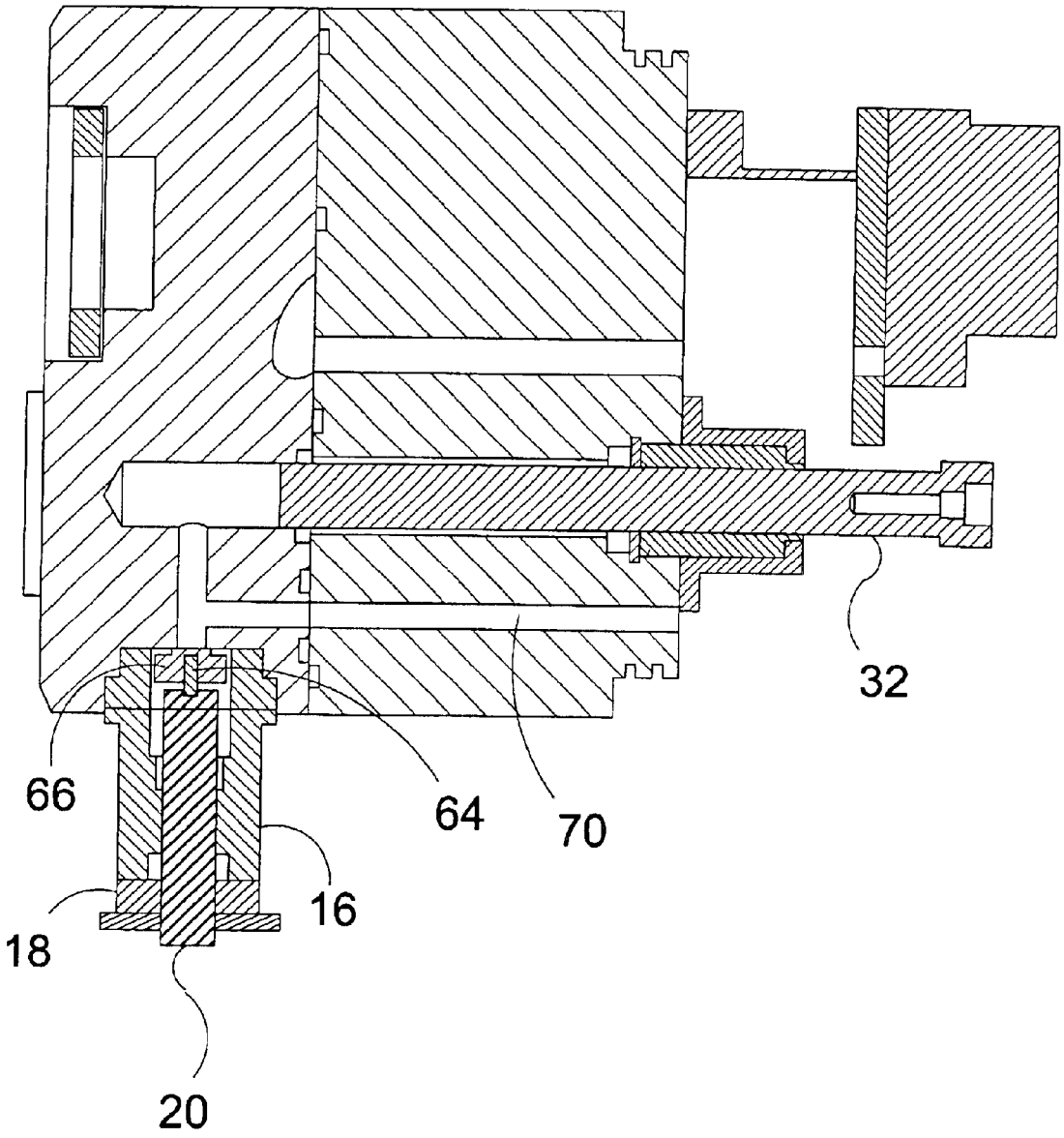
FIG. 10 is a cross sectional side view of the present invention.

FIG. 10 is a cross sectional side view of the present invention with the waste vacuum port assembly 16 shown in detail. The waste vacuum port assembly has a spacer 18 and rotating cap assembly 20. The rotating cap assembly is connected to an O-ring seal 66 by a threaded stud 64 that provides for the engagement or disengagement of the O-ring seal 66. In the disengaged position vacuum may be drawn.

Figure 11:
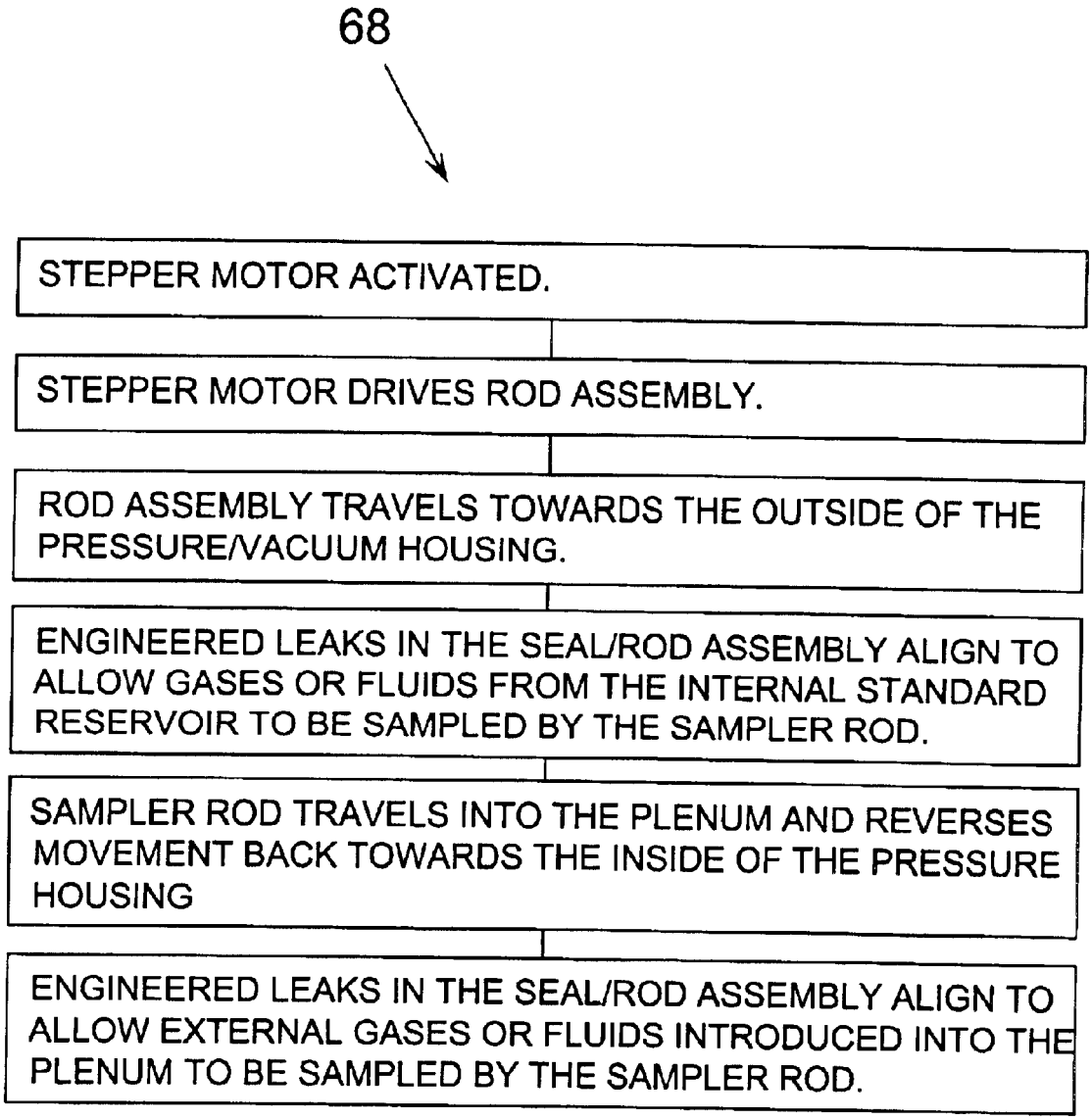
FIG. 11 is a flow chart of the operation of the present invention.

FIG. 11 is a flow chart 68 showing the basic operation of the present invention. The stepper motor 22 under a control signal moves the driving rod 32 which in turn moves the sampler rod 42 having a plurality of engineered micro leaks toward a housing aperture having a retaining ring 40 attached thereto. The sampler rod micro leaks pick up sample material from the internal standard reservoir 62 which are conducted to the mass spectrometer by means of sampler port 60. On the return stroke the sampler rod micro leaks pick up environmental sample material which is conducted to the mass spectrometer by means of vacuum chamber 60.

What is claimed is new and desired to be protected by Letters Patent is set forth in the appended claims:

1. A device for introducing liquids or gas into a mass spectrometers vacuum comprising:

a) a housing encompassing an internal standard reservoir;

b) a stepper motor mounted on an outside wall of said housing;

c) a guide rod extending through said wall into said housing under control of said stepper motor;

d) a sampler rod having engineered leaks for introducing environmental matter into said reservoir, said sampler rod being within said reservoir and slidable out through an opposite wall of said housing engaged to and driven by said guide rod, the sampler rod under the guidance of the stepper motor moving from an engaging position with a predetermined known sample material inside of the internal standard reservoir to an engaging external position with an environmental material to be sampled so as to permit alternate sampling of said known sample material and said environmental material; and e) a pressure compensating bladder mounted in said opposite wall of said housing; and f) means for mounting said device on a mass spectrometer for providing sealed communication between said reservoir and said spectrometer.

2. The device of claim 1 wherein said sealing means includes said housing having a fastening element with said fastening element having a plurality of fastening element engaging O-rings.

3. The device of claim 1 wherein said sealing means includes said housing having a threaded element with said threaded element having a plurality of circumferentially mounted engaging O-rings.

4. The device of claim 1 wherein said stepper motor is responsive to a control signal.

5. The device of claim 4 wherein said stepper motor longitudinally moves said guide rod a predetermined distance specified by said control signal.

6. The device of claim 5 wherein said guide rod has a sampler rod engaging member for moving said sampler rod in conjunction with said guide rod.

7. The device of claim 1 wherein the housing has sealing means circumferentially engaging said sampler rod.

8. The device of claim 6 wherein the sampler rod while residing within the housing is substantially encompassed by a cavity having conduit communication with a mass spectrometer vacuum system.

9. The device of claim 8 wherein the known sample material is used to determine the working condition of a mass spectrometer.

10. The device of claim 9 wherein the internal reservoir is in communication with the pressure compensating bladder whereby the known sample material will be subjected to the same pressure as the sampler rod material.

11. The device of claim 10 further comprising a plenum assembly having an attachment ring for mounting said assembly to an environmental sampler to receive said sampler rod.

12. The device of claim 11 wherein said plenum assembly has an internal chamber having an inlet port and an outlet port whereby sample material can be directed across the sampler rod.

13. The device of claim 12 further comprising a waste vacuum port assembly.

14. The device of claim 13 wherein said waste vacuum port has means for mounting said port to the environmental sampler.

15. The device of claim 14 wherein said waste vacuum port has a spacer element and a rotating cap assembly.

16. The device of claim 15 wherein mass spectrometer analysis of the internal standard reservoir sample produces a known quantity that will be used to verify the accuracy of in situ testing.

* * * * *